United States Patent [19]

Yamanaga

[11] Patent Number: 4,550,659

[45] Date of Patent: Nov. 5, 1985

[54] HAMMER DRIVING CIRCUIT FOR A DOT SYSTEM LINE PRINTER

[75] Inventor: Nobuki Yamanaga, Iruma, Japan

[73] Assignee: Ye Data Inc., Tokyo, Japan

[21] Appl. No.: 613,015

[22] Filed: May 22, 1984

Related U.S. Application Data

[63] Continuation of Ser. No. 333,619, Dec. 22, 1981, abandoned.

[30] Foreign Application Priority Data

Jan. 6, 1981 [JP] Japan ..... 56-85

[51] Int. Cl.[4] ..... B41J 3/10

[52] U.S. Cl. ..... 101/93.04; 361/159; 361/167; 361/191

[58] Field of Search ..... 361/159, 160, 166, 167, 361/168.1, 169.1, 191; 101/93.04, 93.05, 93.09, 93.29–93.34; 400/120, 121

[56] References Cited

U.S. PATENT DOCUMENTS

| | | | |
|---|---|---|---|
| 3,340,407 | 9/1967 | Sinclair | 361/166 |
| 4,033,444 | 7/1977 | Beery | 101/93.05 X |
| 4,287,550 | 9/1982 | Wada | 361/166 |
| 4,357,116 | 11/1982 | Oguchi | 400/121 X |

FOREIGN PATENT DOCUMENTS

| | | | |
|---|---|---|---|
| 61486 | 5/1980 | Japan | 400/121 |
| 164177 | 12/1980 | Japan | 400/120 |

*Primary Examiner*—Edgar S. Burr
*Assistant Examiner*—David A. Wiecking
*Attorney, Agent, or Firm*—Wenderoth, Lind Ponack

[57] ABSTRACT

A line printer having a suitable number of hammers which are controlled by electromagnets and which are juxtaposed with equal pitch on a carriage to effect printing while simultaneously shifting the hammers, wherein adjacent hammers are not simultaneously driven to thereby prevent malfunctions due to the influence of adjacent electromagnets.

3 Claims, 12 Drawing Figures

FIG. 4 (a) ODD
FIG. 4 (b) EVEN
FIG. 4 (c) DATA α
FIG. 4 (d) DATA β
FIG. 4 (e) $i_1$
FIG. 4 (f) $i_2$
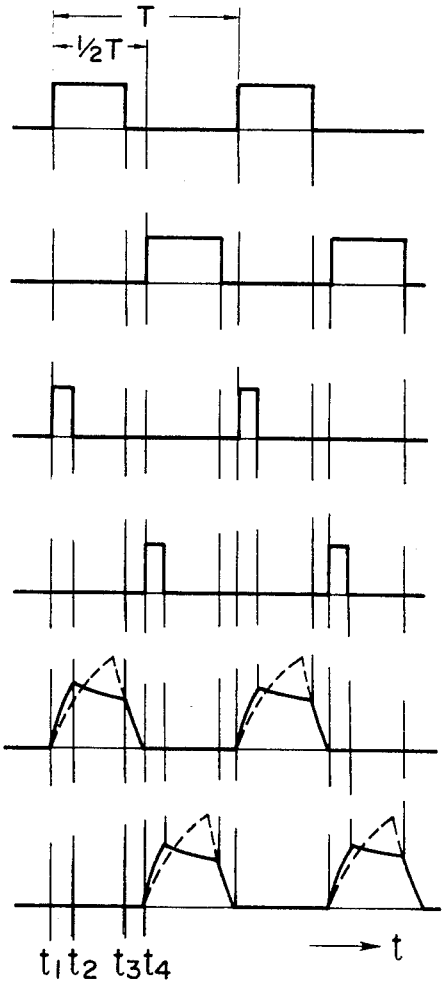
FIG. 5(a)
CONVENTIONAL METHOD
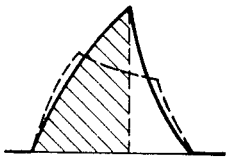
FIG. 5(b)
PRESENT METHOD
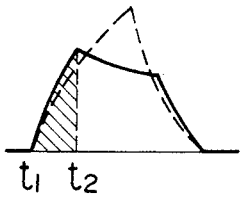

HAMMER DRIVING CIRCUIT FOR A DOT SYSTEM LINE PRINTER

This application is a continuation of now abandoned application Ser. No. 333,619, filed Dec. 22, 1981.

BACKGROUND OF THE INVENTION

The present invention relates to a hammer driving method and a driving circuit therefor which is effective when used in the high speed operation of a dot system line printer, particularly when used in a kanji (Chinese Character) printer which uses characters of many strokes.

As is known, the dot system line printer is designed so that a number of dot hammers which are controlled by electromagnet means are juxtaposed with equal pitch on the carriage to print characters while being simultaneously shifted and having data signals applied to the electromagnet means. However, the high speed operation of the printer reaches a maximum limit.

Thus, a printer for Chinese characters provided with many strokes falls far behind in printing speed when compared to a printer used for English characters or a printer used for katakana, and in this field of art, the high speed operation of the printer is a significant problem to be solved.

SUMMARY OF THE INVENTION

The present invention employs a hammer driving method which is totally different from that of the prior art to render the high speed operation of the dot system line printer possible.

That is, the present invention relates to a driving method which can increase the density of installation (or the number of installations) of hammers.

It is known that if the density of installation of hammers is increased, the printing speed may be increased accordingly. However, electromagnet means are used to drive the hammers, and therefore, if the number of hammers is increased so as to reduce the spaces between the hammers, malfunctions may occur due to the influence of adjacent electromagnet means. Thus, an increase in number of the hammers has an upper limit, and the presently available printer reaches its upper limit and the spaces cannot be further reduced.

In view of the foregoing, the present invention employs a method in which adjacent hammers are not driven simultaneously so as to eliminate the influence caused by the adjacent electromagnet means.

According to the driving method as just mentioned, even if the number of hammers is increased so as to reduce the spaces between the hammers, one electromagnet means is not affected by the other electromagnet means and therefore no malfunction occurs so as to thereby render a higher speed of operation than that possible with prior art devices.

BRIEF DESCRIPTION OF THE DRAWINGS

FIGS. 4(*a*)–4(*f*) are waveforms for explaining the operation of the present invention; and FIGS. 5(*a*)–5(*b*) are comparative views of the respective amount of power to be supplied between the conventional method and the method of the present invention.

DESCRIPTION OF THE PREFERRED EMBODIMENT

Figure 1:
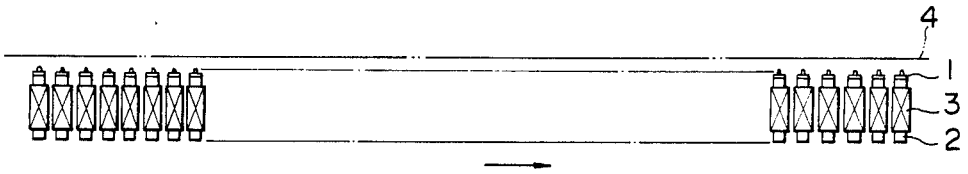
FIG. 1 is a plan view of hammers and a hammer driving device in accordance with one embodiment of the present invention.

FIG. 1 shows a hammer driving device, in which 68 hammers formed from spring plates are juxtaposed on the carriage (not shown); each hammer is normally attracted by a magnetic pole 2 but when a data signal (a driving signal) is applied to a hammer driving coil 3, the magnetic pole 2 is deenergized so as to release the hammer 1 to thereby dot-print a print paper 4, which is constructed similar to the prior art.

Figure 2A:
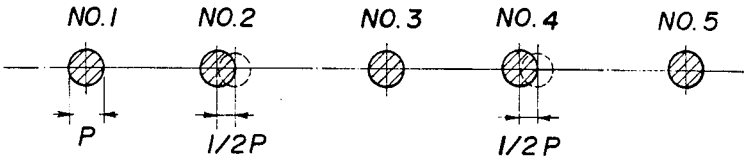
FIGS. 2(*a*) and 2(*b*) are views for explaining the positional relationship between adjacent hammers.
Figure 2B:
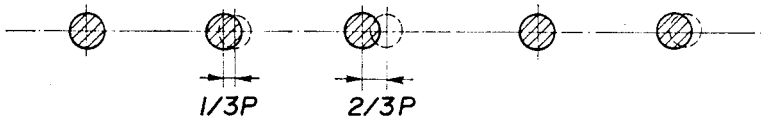
Figure 3:
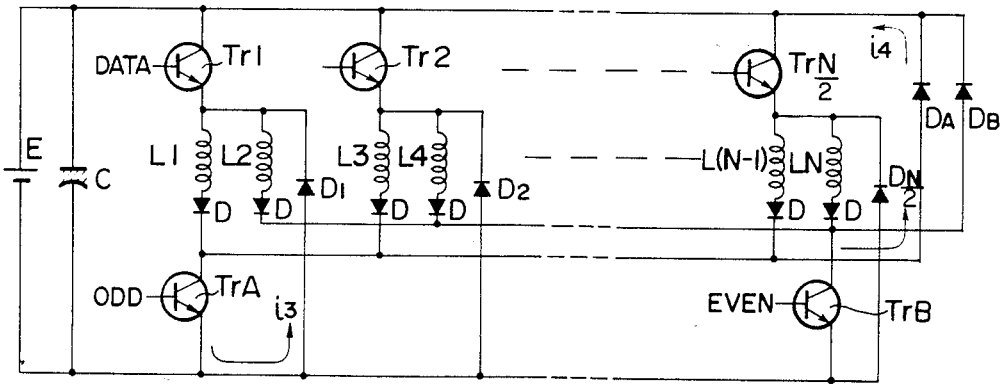
FIG. 3 is a hammer driving circuit diagram.

The device of the present invention is different from prior art printers in that the even-numbered hammers are displaced toward their returning side (to the left) by $\frac{1}{2}$ of a dot diameter as shown in FIG. 2(*a*) and, as is shown in FIG. 3, the hammer driving coils are arranged in two groups, one for the odd-numbered coils L1, L3, L5, L(N−1) . . . and one for the even-numbered coils L2, L4, L6, LN . . . , and the adjacent hammer driving coils are alternately, but not stimultaneously actuated by data operating transistors (electrical switches) Tr1, Tr2 . . . TrN/2 and group operating transistors (electrical switches) TrA and TrB.

Reference character E designates a DC driving power source, and a capacitor C for supplying a pulse of current is connected in parallel therewith.

One end of each of the same group (i.e.-odd or even) group of hammer driving coils are connected to a negative (−) side of the DC driving power source E through anti-inhibit diodes D and one of the operating transistors TrA or TrB, whereas all of the other ends of all of the coils are connected to a positive (+) side of the DC driving power source E through the data operating transistors Tr1, Tr2 . . . TrN/2.

Furthermore, fly-wheel diodes $D_1$, $D_2$ . . . $D_{N/2}$ are connected in parallel with a series circuit comprising the hammer driving coils, anti-inhibit diodes and group operating transistors, and fly-wheel diodes $D_A$ and $D_B$ are connected in parallel with a series circuit comprising the data operating transistors, hammer driving coils and anti-inhibit diodes.

Operating signals designated ODD and EVEN are alternately fed to the group operating transistors TrA, TrB as shown in FIGS. 4(*a*) and 4(*b*).

Thus, when the data signal DATA $\alpha$, as shown in FIG. 4(*c*), is fed to the transistor Tr1 and the ODD group signal ODD fed to the group operating transistor TrA, the transistors Tr1 and TrA are turned on during the time $t_1$–$t_2$ so that a current flows into the hammer driving coil L1 to cause printing by the first hammer. During the time $t_2$–$t_3$, the data signal DATA $\alpha$ disappears so that only the transistor TrA remains turned on, and a circulating current caused by the hammer driving coil L1 flows into a circuit of L1→D→TrA→$D_1$→L1. When the group signal ODD disappears at the time $t_3$, a feedback current $i_4$ caused by the hammer driving coil L1 flows via the diodes D and $D_A$ during the time $t_3$–$t_4$.

Accordingly, in this case, the current waveform is as shown in FIG. 4(*e*).

Likewise, if the odd group operating transistor TrB is actuated, the current waveform is as shown in FIG. 4(*f*).

As can be seen from FIG. 3, the above-described hammer driving circuit requires the additional group driving transistors TrA and TrB but the data operating transistors are reduced in half, and even if the fly-wheel diodes are provided, the circuit may be manufactured at low cost.

In addition, since the use of the fly-wheel diodes causes the lowering of a peak value of the current waveform in prior art device as indicated by the dotted line in FIGS. 4(*e*)–4(*f*), the capacitor C having a low voltage will suffice, thus achieving the actual advantages such as compactness and reduction in cost.

Moreover, power is supplied by the DC driving power source during the time $t_1$–$t_2$, and the power device may be reduced in volume as compared with prior art devices.

FIGS. 5(*a*)–5(*b*) are comparative views of the respective amount of power to be supplied between a conventional method and a method of the present invention, the hatched line indicating the amount of power supplied. As can be best seen from FIGS. 5(*a*)–5(*b*), the present method makes it possible to reduce the consumption of electric power.

Furthermore, since the capacitor C is low in voltage and the coils have a decrease in their temperature rise, an extension of their operating time and an increase in their response frequency is possible, thus contributing to high speed operation; accordingly, the embodiment is an effective circuit for use as the hammer driving circuit.

While in the above-described embodiment, there are two groups of coils, it will be understood that the hammers may be divided into (n+1) groups with hammers at intervals of the number (n+1) being set to one group so that the hammers may be driven in order starting with the first group of hammers.

In the present invention, the hammers under that of the second group are driven later, and thus, the hammers must be displaced in position through a portion of movement of the carriage. However, where the hammers are divided into three groups, the second and third groups of hammers are arranged as shown in FIG. 2(*b*); i.e. the second group of hammers are displaced leftwards by $\frac{1}{3}$ dot from the equal pitch position and the third group of hammers are displaced leftwards by $\frac{2}{3}$ dot. In this manner, the dot printing may be carried out at a proper position similar to the prior art system wherein the hammers are disposed in an equally spaced relationship.

I claim:

1. A hammer driving circuit for a dot system line printer, said printer having a plurality of hammers which are controlled by an electromagnet means including hammer driving coils and which are arranged in a row on a carriage, printing being effected while simultaneously shifting said hammers, wherein said hammers are divided into (n+1) interspersed groups which are arranged such that two hammers from one group are separated by one hammer from each of said other groups, wherein n is a positive integer, and the hammers of all but one of said groups are arranged so as to be displaced from a position in said row that they would be in if all of said hammers were arranged such that adjacent hammers in said row were spaced apart by equal distances, and wherein one end of the hammer driving coils of the same group are respectively connected to a negative terminal of a DC driving power source through an anti-inhibit diode and group operated electrical switches, and wherein the other end of each of said hammer driving coils is connected to a positive terminal of said DC driving power source through a data operated electrical switch, and wherein fly-wheel diodes are respectively connected to parallel with each series circuit comprising said hammer driving coils, said anti-inhibit diode and said group operated electrical switches; and wherein each of said group operated electrical switches are driven once in a pulse repetition period of each of said hammer driving circuits by a first pulse driving signal having a pulse width which is less than or equal to 1/(n+1) times its pulse repetition period and said data operated electrical switches are selectively driven as necessary by a second pulse driving signal having a pulse width which is less than that of said first pulse driving signal and having a pulse repetition period which is equal thereto so as to thereby print said desired characters.

2. A circuit as recited in claim 1, wherein said hammers of one group of displaced hammers are displaced by an amount equal to P/(n+1), where P is the width of a dot.

3. A circuit as recited in claim 2, wherein said hammers of another group of displaced hammers are displaced by an amount equal to 2P/(n+1).

* * * * *